US007757814B2

(12) United States Patent
Pleadwell et al.

(10) Patent No.: US 7,757,814 B2
(45) Date of Patent: Jul. 20, 2010

(54) LADDER STABILIZER

(75) Inventors: Stephen Pleadwell, Red Deer (CA); Martin Claussen, Powell River (CA)

(73) Assignee: Ladder Stabilizerz Inc., Alberta (CA)

( * ) Notice: Subject to any disclaimer, the term of this patent is extended or adjusted under 35 U.S.C. 154(b) by 542 days.

(21) Appl. No.: 11/789,224

(22) Filed: Apr. 24, 2007

(65) Prior Publication Data

US 2007/0251763 A1 Nov. 1, 2007

(51) Int. Cl.
*E06C 7/00* (2006.01)

(52) U.S. Cl. ..... 182/172; 182/107

(58) Field of Classification Search ..... 182/172, 182/200, 107, 214, 203, 201
See application file for complete search history.

(56) References Cited

U.S. PATENT DOCUMENTS

| | | | | | |
|---|---|---|---|---|---|
| 2,327,317 | A | * | 8/1943 | Randall | 182/214 |
| 2,354,904 | A | | 8/1944 | Young | |
| 2,552,941 | A | | 5/1951 | Courtney | |
| 3,059,723 | A | | 10/1962 | Shore | |
| 3,395,776 | A | | 8/1968 | Russell | |
| 3,937,298 | A | * | 2/1976 | Hurwitz | 182/200 |
| 4,207,886 | A | | 6/1980 | Sorenson | |
| 4,565,262 | A | | 1/1986 | Hawkins | |
| 4,832,912 | A | * | 5/1989 | Yabuki et al. | 420/586 |
| 4,899,849 | A | | 2/1990 | Levi et al. | |
| 4,964,488 | A | | 10/1990 | Stewart | |
| 5,267,631 | A | * | 12/1993 | Mendel | 182/107 |
| 5,423,397 | A | | 6/1995 | Boughner | |
| 5,590,739 | A | | 1/1997 | High et al. | |
| 5,868,222 | A | | 2/1999 | Charbonneau | |
| 6,152,262 | A | | 11/2000 | Jung | |
| 6,167,989 | B1 | | 1/2001 | Jung | |
| 6,527,084 | B2 | | 3/2003 | Hrincu | |
| 6,575,268 | B2 | | 6/2003 | Carder et al. | |
| 6,929,095 | B2 | | 8/2005 | Brygger | |
| 6,959,785 | B1 | | 11/2005 | Chilton | |
| 2002/0056591 | A1 | | 5/2002 | Hrincu | |
| 2004/0231921 | A1 | | 11/2004 | Ramirez | |

FOREIGN PATENT DOCUMENTS

| | | | |
|---|---|---|---|
| DE | 3208560 A1 | * | 10/1983 |
| WO | WO 8302796 A1 | * | 8/1983 |

* cited by examiner

*Primary Examiner*—Alvin C Chin-Shue
(74) *Attorney, Agent, or Firm*—Davis & Bujold, P.L.L.C.

(57) ABSTRACT

A ladder stabilizer for ladders with tubular rungs, includes a rigid stabilizer bar having a top, a bottom, a first end and a second end. A first leg extends downwardly below the bottom of the stabilizer bar at the first end and a second leg extends downwardly below the bottom of the stabilizer bar at the second end. A rung attachment bar is provided which is adapted to extend through a tubular rung of a ladder. The rung attachment bar has a first end and a second end. Clamps are provided for securing the rung attachment bar in parallel spaced relation to the stabilizer bar.

2 Claims, 2 Drawing Sheets

LADDER STABILIZER

FIELD OF THE INVENTION

The present invention relates to a ladder stabilizer which has a bar that extends through a rung of a ladder.

BACKGROUND OF THE INVENTION

A number of ladder stabilizers have been patented which teach extending a bar through a rung of a ladder and then securing the bar to telescopic support legs. Those patents include: U.S. Pat. No. 5,423,397 (Boughner 1995), U.S. Pat. No. 6,527,084 (Hrincu 2003) and U.S. Patent Application US 2004/0231921 (Ramirez 2004).

SUMMARY OF THE INVENTION

According to the present invention there is provided a ladder stabilizer for ladders with tubular rungs, which includes a rigid stabilizer bar having a top, a bottom, a first end and a second end. A first leg extends downwardly below the bottom of the stabilizer bar at the first end and a second leg extends downwardly below the bottom of the stabilizer bar at the second end. A rung attachment bar is provided which is adapted to extend through a tubular rung of a ladder. The rung attachment bar has a first end and a second end. Means are provided for securing the rung attachment bar in parallel spaced relation to the stabilizer bar.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
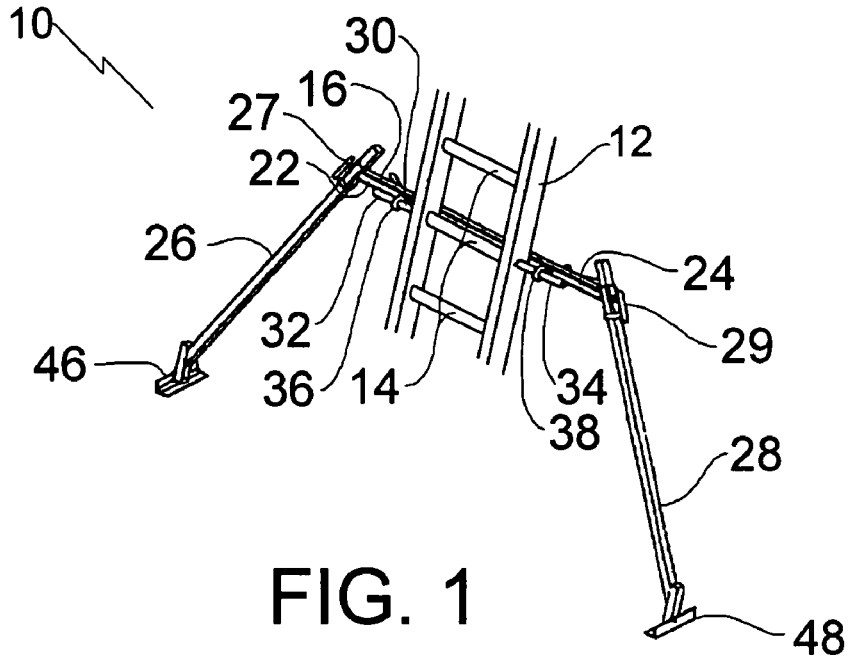
FIG. 1 is a perspective view of the ladder stabilizer.

The preferred embodiment, a ladder stabilizer generally identified by reference numeral 10, will now be described with reference to FIGS. 1 through 3.

Figure 2:
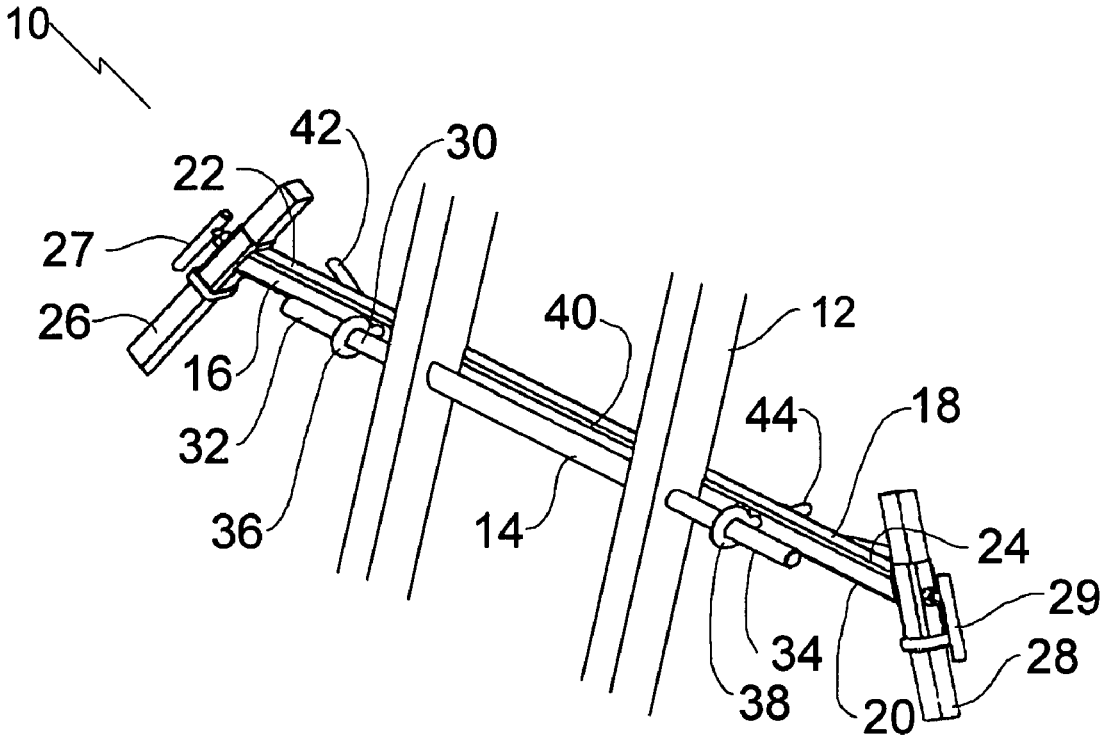
FIG. 2 is a detailed perspective view of the ladder stabilizer bar and rung attachment bar.

Structure and Relationship of Parts:

Referring now to FIG. 2, ladder stabilizer 10 for ladders 12 with tubular rungs 14 includes a rigid stabilizer bar 16 having a top 18, a bottom 20, a first end 22 and a second end 24. Referring to FIG. 1, there is a first leg 26 and a second leg 28 that extend downwardly below bottom 20 of stabilizer bar 16 with first leg 26 at first end 22 and second leg 28 at second end 24. The position of stabilizer bar 16 on legs 26 and 28 is adjustable by means of clamps 27 and 29. Referring to FIG. 2, there is also included a rung attachment bar 30 having a first end 32 and a second end 34. As depicted, stabilizer bar 16 is longer than rung attachment bar 30. Rung attachment bar 30 is adapted to extend through tubular rung 14 of ladder 12. Referring to FIG. 2 and FIG. 3, there is also provided means for securing the rung attachment bar 30 in parallel spaced relation to stabilizer bar 16. For example, the means may includes a first eye bolt 36 and a second eye bolt 38 that act as first and second securing means for securing first end 32 and second end 34 of rung attachment bar 30 to stabilizer bar 16, respectively. In addition, stabilizer bar 16 has a ladder engaging face 40, and first eye bolt 36 and second eye bolt 38 are adjustable by adjusting handles 42 and 44, thereby allowing a clamping force to be exerted when ladder 12 is positioned between the rung attachment bar 30 and ladder engagement face 40 of stabilizer bar 16, as shown in FIGS. 1 and 2.

Referring to FIG. 1, first and second legs 26 and 28 have feet 46 and 48, respectively. The actual configuration of feet 46 and 48 may be changed, depending on the situation. For example, when the surface that ladder stabilizer 10 will be used on is concrete or a hard packed surface, common extension ladder feet may be sufficient. On the other hand, for construction worksites, it may be preferable to include a 1 inch cleated padding on the bottom of each foot 46 and 48, which would penetrate into the ground and help stabilize the base of the ladder. Another option is to use anchor pins that can be hammered through a sleeve and into the ground (not shown). In this option, the sleeve would be welded to the base of each leg 26 and 28 at the point where the foot attaches.

Figure 3:
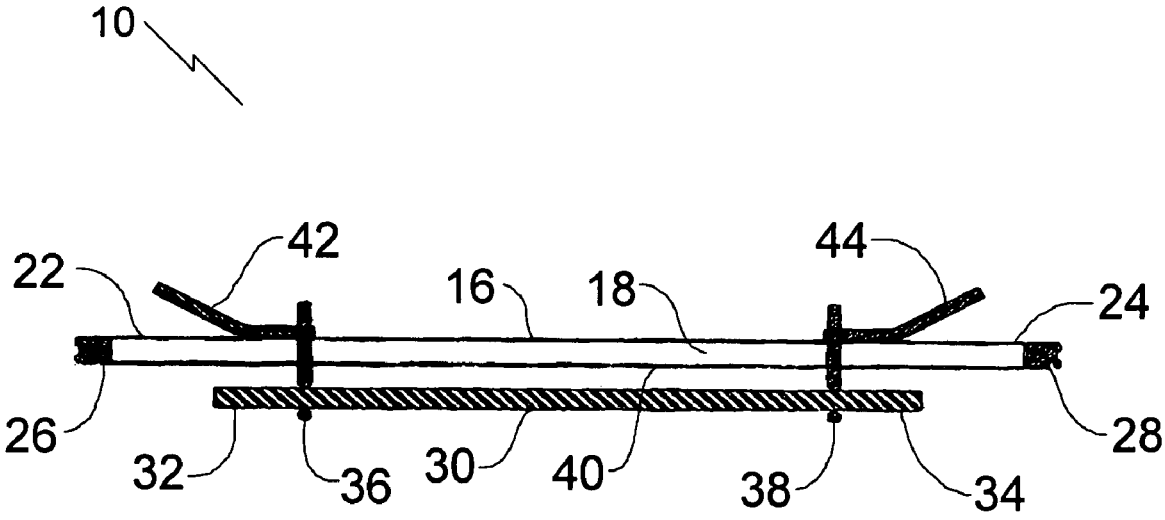
FIG. 3 is a top plan view in section of the ladder stabilizer of FIG. 1.

Operation:

Referring to FIGS. 1 through 3, ladder stabilizer 10 is provided as describe above. It will be understood that the order of the steps below are exemplary, and may be taken in any convenient order. Referring to FIG. 1, a first step involves securing ladder 12 to stabilizer bar 16. This is done by inserting rung attachment bar 30 through the appropriate tubular rung 14 and through first and second securing eye bolts 36 and 38. Ladder 12 is thus positioned against ladder engagement face 40 of stabilizer bar 16, and a clamping force is exerted by adjusting handles 42 and 44. The position of first leg 26 and second leg 28 relative to stabilizer bar 16 is then selected to provide stabilizing support to ladder 12. This is done by temporarily releasing clamps 27 and 29 and then moving first leg 26 and second leg 28, up or down. Clamps 27 and 29 are then tightened to fix first leg 26 and second leg 28, respectively, in the selected position.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the claims.

What is claimed is:

1. A ladder stabilizer for ladders with tubular rungs, comprising in combination:

a ladder having hollow tubular rungs;

a rigid stabilizer bar having a top, a bottom, a first end and a second end;

a first leg extending downwardly below the bottom of the stabilizer bar at the first end and a second leg extending downwardly below the bottom of the stabilizer bar at the second end a rung attachment bar extending through one of the tubular rungs of the ladder, and the rung attachment bar having a first end and a second end; and means for securing the rung attachment bar in parallel spaced relation to the stabilizer bar, wherein the means for securing the rung attachment bar in parallel spaced relation to the stabilizer bar includes a first eye bolt securing the first end of the rung attachment bar to the stabilizer bar and a second eye bolt securing the second end of the rung attachment bar to the stabilizer bar, the rung attachment bar being extended through the first eye bolt and the second eye bolt, wherein the stabilizer bar has a ladder engaging face, and the first eye bolt and the second eye bolt have handles that are axially adjustable along each eye bolt thereby exerting a clamping force that clamps the ladder between the rung attachment bar and the stabilizer bar with the ladder engaging face abutting an outer surface of the ladder rails.

2. The ladder stabilizer as defined in claim 1, wherein the stabilizer bar is longer than the rung attachment bar.

* * * * *

UNITED STATES PATENT AND TRADEMARK OFFICE

CERTIFICATE OF CORRECTION

PATENT NO. : 7,757,814 B2
APPLICATION NO. : 11/789224
DATED : July 20, 2010
INVENTOR(S) : Stephen Pleadwell et al.

It is certified that error appears in the above-identified patent and that said Letters Patent is hereby corrected as shown below:

Title Page insert

--(30) Foreign Application Priority Data

April 24, 2006 (CA) .....2,543,948--

Signed and Sealed this
First Day of March, 2011

David J. Kappos

David J. Kappos
*Director of the United States Patent and Trademark Office*